US005943923A

United States Patent [19]

Shih

[11] Patent Number: 5,943,923

[45] **Date of Patent: *Aug. 31, 1999**

[54] RETAINING DEVICE OF SOCKET SPANNER

[76] Inventor: Leo Shih, No. 5, La. 54 San Min Rd., Sec. 3, Taichung, Taiwan

[ * ] Notice: This patent is subject to a terminal disclaimer.

[21] Appl. No.: 08/998,686

[22] Filed: Dec. 29, 1997

[51] Int. Cl.[6] ..... B25B 13/02

[52] U.S. Cl. ..... 81/125; 81/452

[58] Field of Search ..... 81/125, 451, 452, 81/180.1, 177.85, 13

[56] References Cited

U.S. PATENT DOCUMENTS

| | | | |
|---|---|---|---|
| 271,549 | 1/1883 | True | 81/125 |
| 2,304,271 | 12/1942 | Merriman et al. | 81/125 |
| 2,320,044 | 5/1943 | Merriman | 81/125 |
| 3,665,791 | 5/1972 | Carr | 81/125 |
| 3,835,737 | 9/1974 | Carr | 81/125 |
| 4,663,998 | 5/1987 | Parsons et al. | 81/125 |
| 4,787,278 | 11/1988 | Bononi | 81/125 |
| 5,351,586 | 10/1994 | Habermehl et al. | 81/451 |
| 5,724,872 | 3/1998 | Shih | 81/125 |

*Primary Examiner*—David A. Scherbel
*Assistant Examiner*—Joni B. Danganan
*Attorney, Agent, or Firm*—W. Wayne Liauh

[57] ABSTRACT

A socket spanner is disclosed which includes a socket and a U-shaped elastic body. The socket includes: (1) a driven member, a drive member and an intermediate section located therebetween; (2) a pair of longitudinally extending grooves provided on an inner wall of the driven member opposite each other; and (3) a circumferentially disposed circular slot provided near an inner end of the inner wall of the driven member. The U-shaped elastic body includes: (1) two longitudinally extending arms connected by an arcuate bottom portion; (2) a protruded portion formed on one of the longitudinally extending arms of the U-shaped elastic body for exerting an urging force against a nut received by the driven member of the socket. The two longitudinally extending arms are completely received by the pair of longitudinally extending grooves, respectively, and the arcuate bottom portion is completely received in the circumferentially disposed circular slot provided near the inner end of the inner wall of the driven member.

1 Claim, 4 Drawing Sheets

RETAINING DEVICE OF SOCKET SPANNER

FIELD OF THE INVENTION

The present invention relates generally to a socket spanner, and more particularly to a retaining device of the socket spanner.

BACKGROUND OF THE INVENTION

As shown in FIGS. 1 and 2, the prior U.S. patent application Ser. No. 08/672,859 of this inventor of the present invention discloses a socket 20 of the socket spanner which has a drive member 21 provided with a square inner hole. The socket 20 further has a driven member 22 provided with a hexagonal inner hole. Located between the drive member 21 and the driven member 22 is a midsection having a center hole 23. The driven member 22 is provided in the inner wall thereof with two grooves 221 opposite to each other. Located near the outer end of the hexagonal hole is a circular slot 222. An elastic body 24 has a retaining side 241 provided with a protruded portion 242, an arcuate bottom 243, and a curved end portion 244. The retaining side 241 can be forced along the groove 221 into the socket 20 such that the end portion 244 is located in the circular slot 222, and that the arcuate bottom 243 can bypass the center hole 23 to move along the outer ring wall. The protruded portion 242 of the retaining side 241 is thus retained securely in the socket 20 at the time when a nut 25 is engaged with the driven member 22 of the socket 20. In the meantime, the end portion 244 of the elastic body 24 urges against the circular slot 222. When the nut 25 is disengaged, the elastic body 24 is thus prevented from slipping out of the socket 20. The elastic body 24 is defective in design in that the end portion 244 of the elastic body 24 is curved to form an angle, thereby making it difficult to force the elastic body 24 into the socket 20.

SUMMARY OF THE INVENTION

The primary objective of the present invention is to provide a socket spanner with a retaining device free from the structural deficiency of the prior art described above.

In keeping with the principle of the present invention, the foregoing objective of the present invention is attained by developing a socket which is provided at the driven member 22 thereof with a circular slot in which the arcuate bottom of an elastic body is retained securely. The end of the retaining side of the elastic body is not curved so as to facilitate the assembly of the elastic body.

The foregoing objective, features, functions, and advantages of the present invention will be more readily understood upon a thoughtful deliberation of the following detailed description of the embodiments of the present invention with reference to the accompanying drawings.

DETAILED DESCRIPTION OF THE EMBODIMENTS

Figure 1:
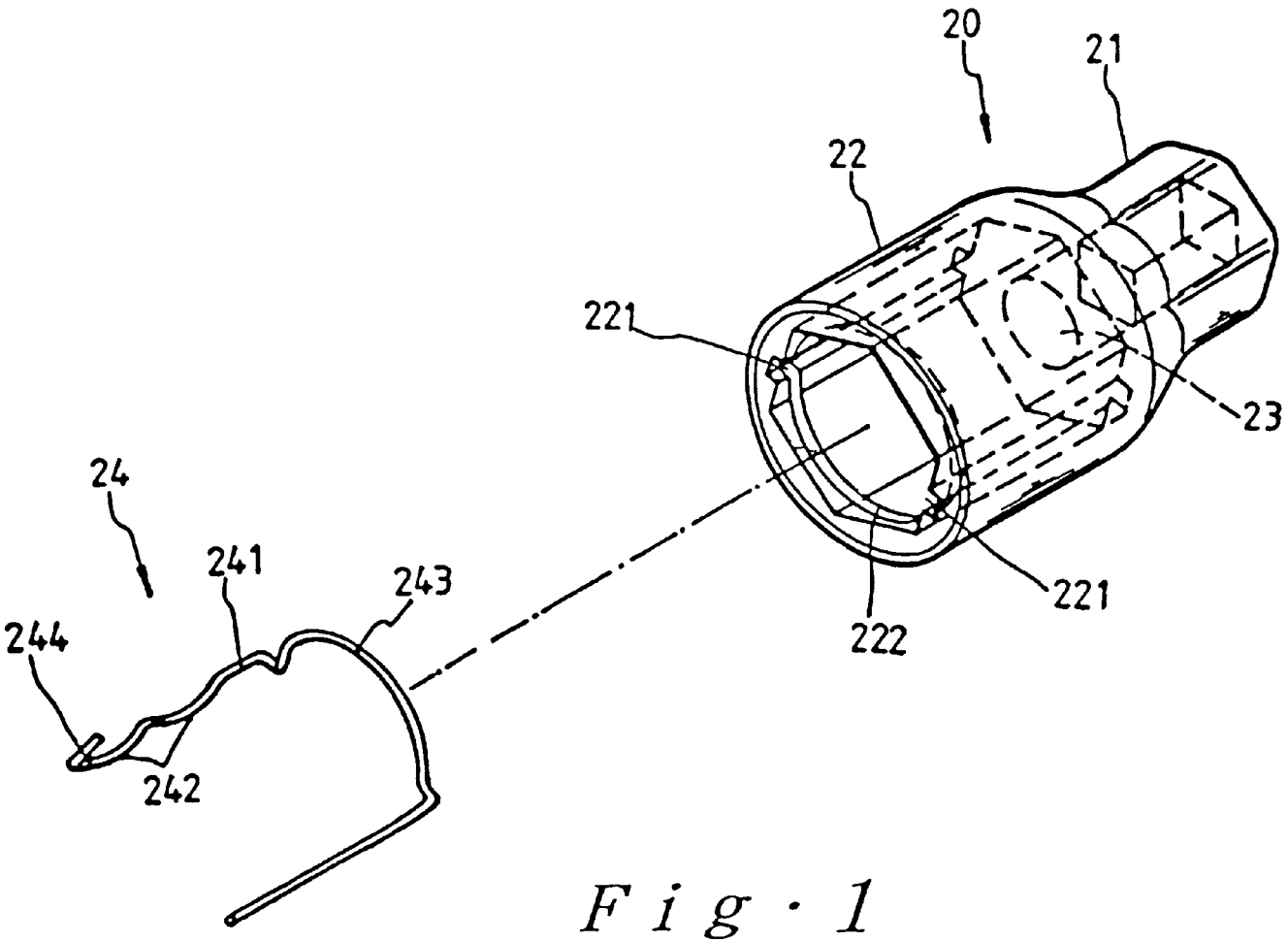
Fig. 1 PRIOR ART
FIG. 1 shows an exploded view of the prior art.
Figure 4:
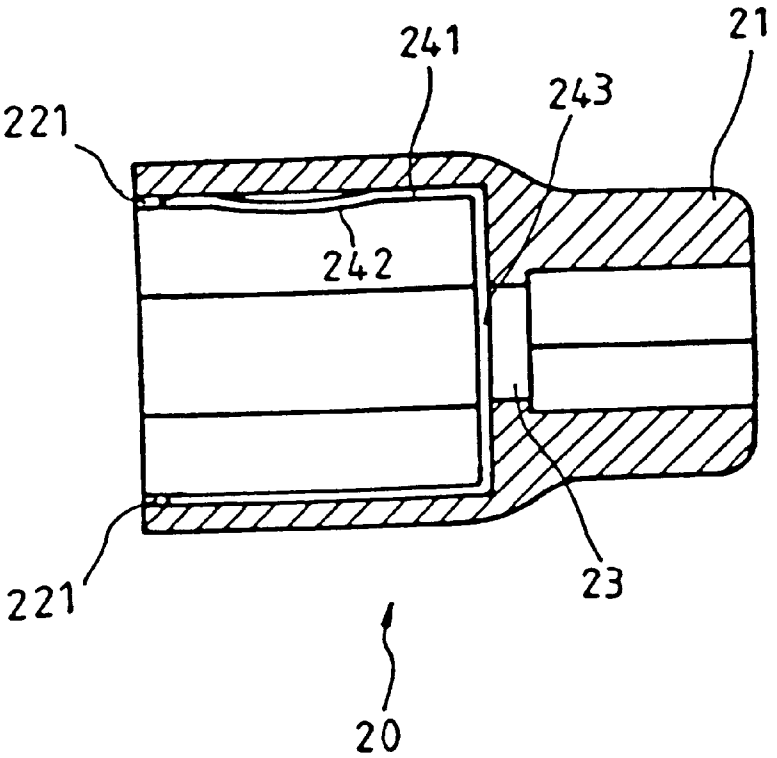
FIG. 4 shows a sectional view of the present invention in combination.
Figure 2:
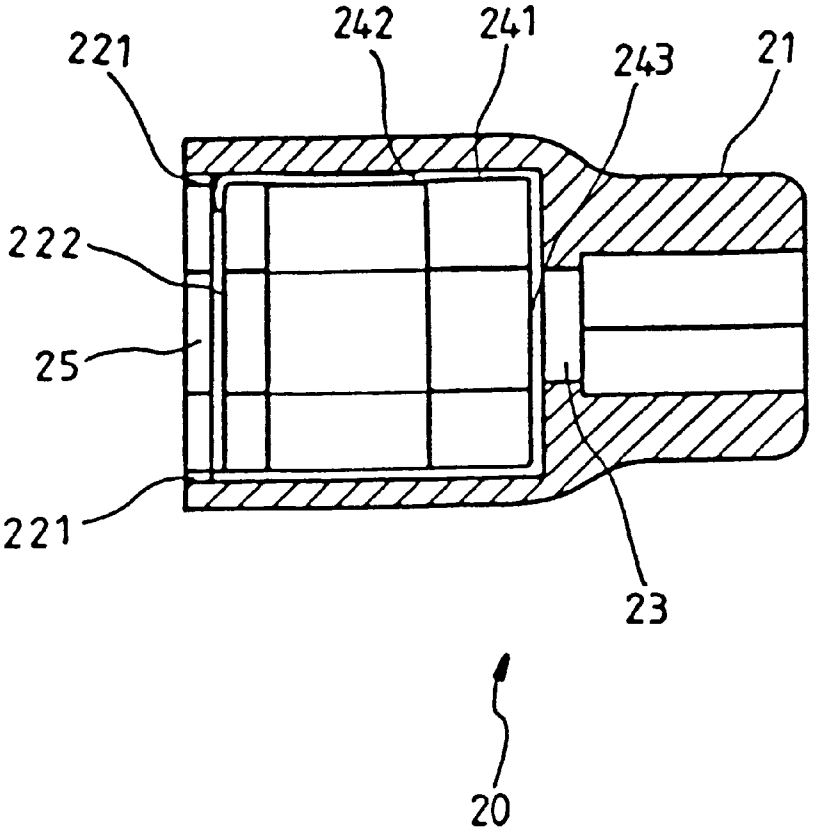
Fig. 2 PRIOR ART
FIG. 2 shows a sectional view of the prior art in combination.
Figure 3:
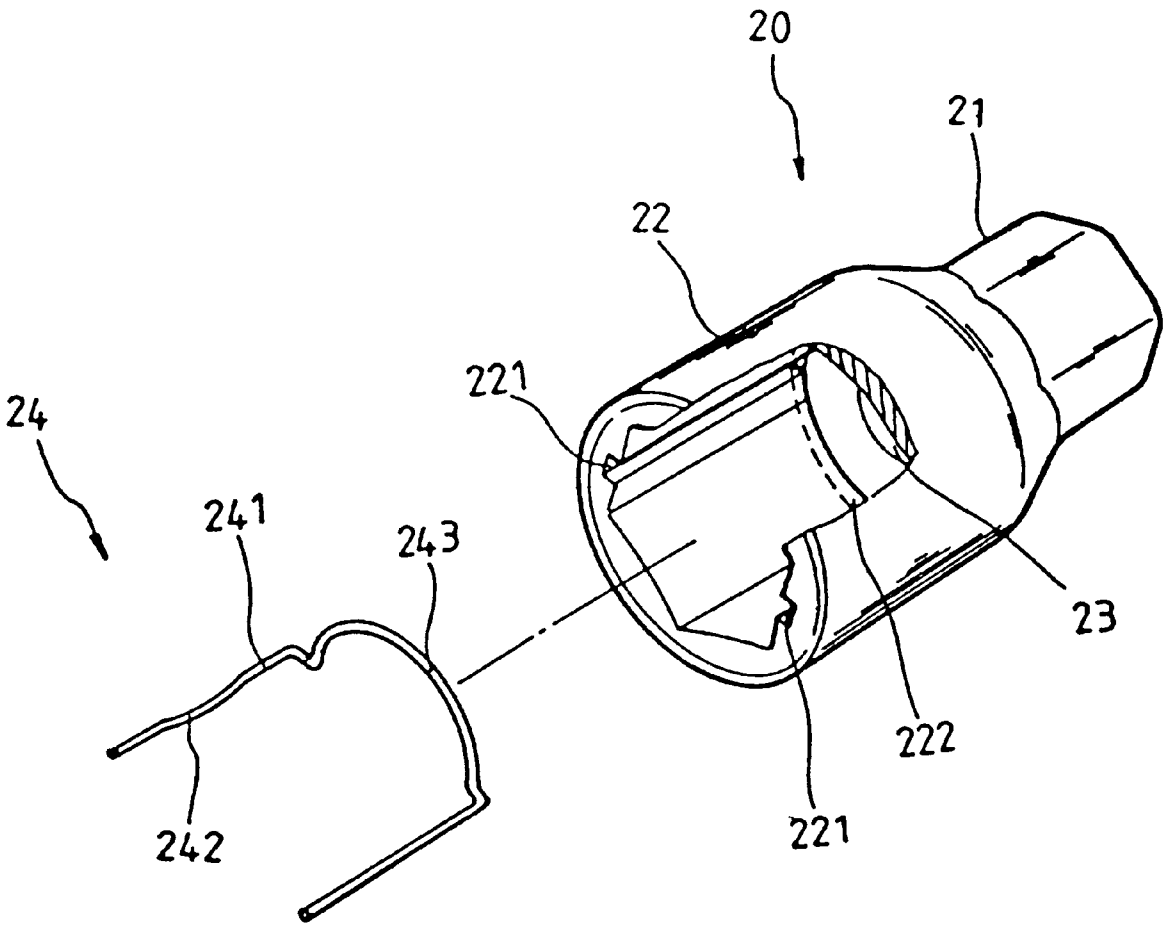
FIG. 3 shows an exploded view of the present invention.

As shown in FIGS. 3 and 4, a socket 20 disclosed in the present invention is composed of a driven member 22 which is provided in the inner wall thereof with two grooves 221 opposite in location to each other. The driven member 22 is further provided in the bottom thereof with a circular slot 222. An elastic body 24 has a retaining side 241 which is provided with a protruded portion 242, and an arcuate bottom 243. The elastic body 24 is forced into the socket 20 such that the retaining side 241 is moved along the groove 221 of the driven member 22. The elastic body 24 is retained by the socket 20 by means of the arcuate bottom 243. In other words, the retaining side 241 of the elastic body 24 of the present invention is devoid of a curved end capable of obstructing the engagement of the elastic body 24 with the socket 20. Without the curved end, the elastic body 24 can be made easily and economically. In addition, the elastic body 24 can be easily joined with the socket 20.

Figure 5:
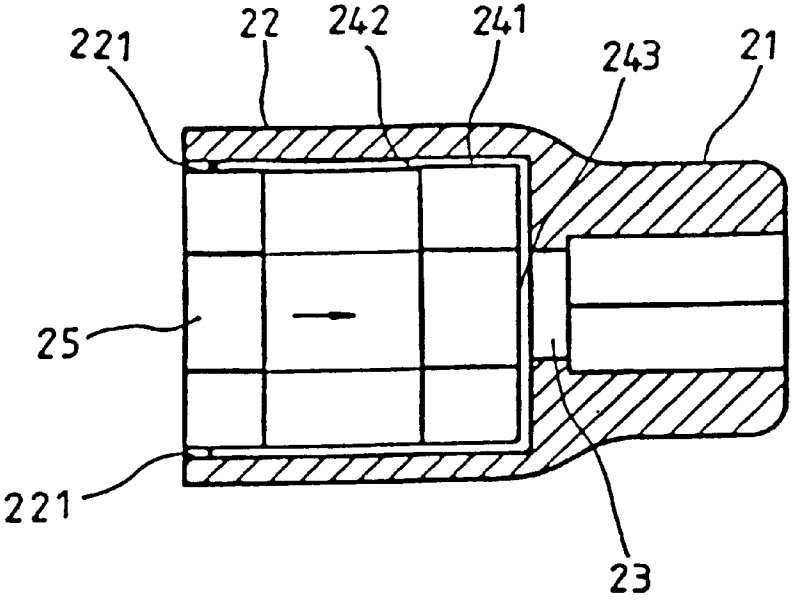
FIG. 5 shows a sectional view of the present invention after the nut is inserted into the socket of the socket spanner.

As illustrated in FIG. 5, a nut 25 is engaged with the driven member 22 of the socket 20 such that the nut 25 is held securely by the elastic force of the protruded portion 242 of the retaining side 241 of the elastic body 24, and that the nut 25 can not be easily disengaged with the socket 20.

Figure 6:
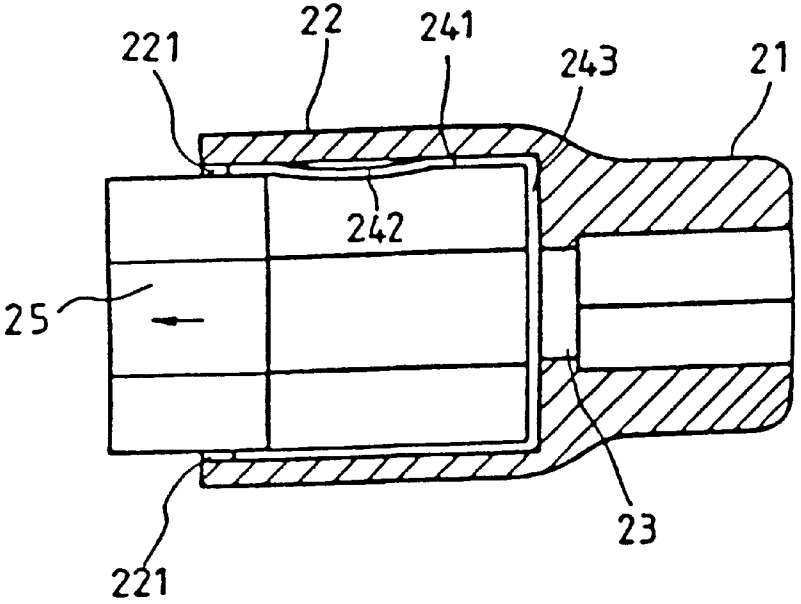
FIG. 6 shows a sectional view of the present invention after the nut is removed from the socket of the socket spanner.

Now referring to FIG. 6, the elastic body 24 is shown to have an arcuate bottom 243, which is retained in the circular slot 222. As the nut 25 is disengaged with the retaining side 242 of the elastic body 24 so as to be taken out of the driven member 22 of the socket 20, the elastic body 24 can be stably located in the driven member 22 of the socket 20 in view of the arcuate bottom 243 which is retained in the circular slot 222. The arcuate bottom 243 of the elastic body 24 plays an important role in retaining and locating the elastic body 24 in the driven member 22 of the socket 20.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A socket spanner comprising a socket and a U-shaped elastic body, wherein said socket comprising:

(a) a driven member, a drive member and an intermediate section located therebetween;

(b) a pair of longitudinally extending grooves provided on an inner wall of said driven member opposite each other; and (c) a circumferentially disposed circular slot provided near an inner end of said inner wall of said driven member and in communication with said longitudinally extending pair of grooves;

further wherein said U-shaped elastic body comprising:

(d) two longitudinally extending arms connected by an arcuate bottom portion;

(e) said two longitudinally extending arms being completely received by said pair of longitudinally extending grooves, respectively, and said arcuate bottom portion being completely received in said circumferentially disposed circular slot provided near said inner end of said inner wall of said driven member; and (f) a protruded portion formed on one of said longitudinally extending arms of said U-shaped elastic body for exerting an urging force against a nut received by said driven member of said socket.

* * * * *